US012535280B2

(12) United States Patent
Fischer et al.

(10) Patent No.: US 12,535,280 B2
(45) Date of Patent: Jan. 27, 2026

(54) SMALL FIREARMS AND METHOD OF OPERATING SMALL FIREARMS

(71) Applicant: Schmeisser GmbH, Krefeld (DE)

(72) Inventors: Michael Fischer, Duisburg (DE); Thomas Hoff, Krefeld (DE); Andreas Schumacher, Krefeld (DE)

(73) Assignee: Schmeisser GmbH, Krefeld (DE)

( * ) Notice: Subject to any disclaimer, the term of this patent is extended or adjusted under 35 U.S.C. 154(b) by 199 days.

(21) Appl. No.: 18/415,240

(22) Filed: Jan. 17, 2024

(65) Prior Publication Data

US 2024/0240887 A1 Jul. 18, 2024

(30) Foreign Application Priority Data

Jan. 17, 2023 (DE) ..... 10 2023 000 131.7
Jan. 18, 2023 (DE) ..... 10 2023 000 143.0

(51) Int. Cl.
*F41A 3/30* (2006.01)
*F41A 3/26* (2006.01)
*F41A 21/12* (2006.01)

(52) U.S. Cl.
CPC *F41A 3/30* (2013.01); *F41A 3/26* (2013.01); *F41A 21/12* (2013.01)

(58) Field of Classification Search
CPC ..... F41A 3/16; F41A 3/14; F41A 3/30; F41A 3/26; F41A 9/55; F41A 15/14
See application file for complete search history.

(56) References Cited

U.S. PATENT DOCUMENTS 6,708,437 B2 3/2004 Murello
6,898,888 B2 5/2005 Greenhut
9,038,303 B1 * 5/2015 Olson ..... F41A 15/14 42/25

(Continued)

FOREIGN PATENT DOCUMENTS

DE 10 2020 004 940 A1 2/2022

OTHER PUBLICATIONS

C.I.P. Patronen—und Patronenlagermasstabelle (TDCC), Tab. IV, Revision Aug. 9, 23, 9 mm Luger, https://bobp.cip-bobp.org/uploads/tdcc/tab-iv/tabivcal-de-page28.pdf (1 page).

(Continued)

*Primary Examiner* — J. Woodrow Eldred
(74) *Attorney, Agent, or Firm* — TAYLOR & EDELSTEIN, PC

(57) ABSTRACT

A small firearm includes: a receiver; a barrel including a barrel bore axis; an action including a bolt head; and a guide surface, the receiver being configured for (i) at least indirectly receiving the barrel including a locking mechanism area, a chamber, a guide area, and a muzzle arranged successively in the longitudinal direction, and (ii) at least indirectly receiving the action movably arranged within the receiver along the longitudinal direction from an open position to a closed position, the guide surface, which is within a locking space, being configured such that at least one of (i) an entry of a cartridge case under an influence of a torque during a movement of the action from a closed position to an open position is limited due to an interaction of an ejector and an extractor and (ii) an exit of the cartridge case is favored.

20 Claims, 13 Drawing Sheets

(56) References Cited

U.S. PATENT DOCUMENTS

| | | | | |
|---|---|---|---|---|
| 2007/0033851 | A1 | 2/2007 | Hochstrate et al. | |
| 2022/0333889 | A1 | 10/2022 | Sereinig | |
| 2023/0160651 | A1* | 5/2023 | Mortsch | F41A 15/14 42/25 |
| 2023/0341203 | A1* | 10/2023 | Bilgeri | F41A 15/10 |
| 2024/0384953 | A1* | 11/2024 | Sun | F41A 3/88 |

OTHER PUBLICATIONS

German Office Action dated Sep. 25, 2023 for German Patent Application No. 10 2023 000 143.0 (9 pages).

* cited by examiner

SMALL FIREARMS AND METHOD OF OPERATING SMALL FIREARMS

CROSS REFERENCE TO RELATED APPLICATIONS

This claims priority to: (1) German patent application no. 10 2023 000 131.7, filed Jan. 17, 2023, which is incorporated herein by reference; and (2) German patent application no. 10 2023 000 143.0, filed Jan. 18, 2023, which is incorporated herein by reference.

BACKGROUND OF THE INVENTION

1. Field of the Invention

The present invention relates to small firearms.

2. Description of the Related Art

Small firearms have been known for a long time and are manufactured in various designs according to the state of the art. The person skilled in the art first distinguishes between small firearms whose overall length is short, generally less than 600 millimeters, and which are called "handguns" or "pistols," and those whose overall length is relatively long, generally more than 600 mm, and which are then called "long guns," "guns" or, somewhat more precisely, "rifles" (profiled barrels) or "shotguns" (smooth barrels), depending on the configuration of the inner profile of their barrel.

Examples of small firearms configured in this way are guns based on the AR-15 model, some of which are named differently depending on the caliber, but also other guns such as the models G36 or SL8 from Heckler & Koch, the model 550 from SIG (Schweizer Industrie Gesellschaft), various AK 47 and AK 74 models and their derivatives, the Dragunov gun, the IZHMASH Tigr model, the Ruger Mini 14, the Browning BAR, the model 100 from Winchester, the Remington M 81 or M 7400, the Garand M1 and many others.

Handguns which include the above characteristics are much more rarely found. The main representatives here are the AutoMag models 160, 180 and 280 as well as the Dessert Eagle pistol manufactured by IMI and Magnum Research in various calibers.

The person skilled in the art also fundamentally distinguishes between small firearms with permanently attached cartridge magazines and those whose cartridge magazines can be quickly and repeatedly attached to the small firearms by releasing a retaining mechanism. Fixed magazines generally offer the advantage of being undetachable and the disadvantage that reloading is comparatively time-consuming. In general, the cartridges must be inserted individually via the magazine lips of the fixed magazine, regardless of whether the fixed magazine is configured in the form of a box, in which the cartridges to be inserted are mounted in such a way that the cartridge jacket surfaces touch each other, or whether it is configured in the form of a tubular magazine, in which the cartridges to be inserted touch each other nose to end. Although quick-loading systems, such as clips or charge tubes, are known for both variants, they are usually only moderately practical to use and have therefore been irrelevant for many decades, in particular in use by authorities.

Detachable cartridge magazines, also known as insertable cartridge magazines, are primarily known from drum magazines and box magazines. In turn, box magazines are basically divided into linear box magazines, also known as column magazines, and curved box magazines. In a box magazine, the cartridges are stored in such a way that they touch each other tangentially at their case walls when the cartridge magazine is at least partially filled within the housing of the cartridge magazine. Depending on whether the box magazine is configured with a single-column or multiple columns, and depending on whether it is a linear type or a curved type, the contact points or the contact lines of the cartridges shift tangentially and/or axially with respect to each other, wherein the type and degree of the shift can also be highly dependent on the fill level of the cartridge magazine, which fill level may also change in discrete steps at high frequency during operation.

A further fundamental distinguishing feature of small firearms of the type mentioned above is the design of the loading mechanism, which is to say, the way in which the barrel (namely the chamber of the barrel) of the small firearm is loaded with the cartridges to be removed from the cartridge magazine(s). Inasmuch as the loading process repeatedly brings the small firearm into a ready-to-fire state, the loading process is generally referred to as the repeater loading process. In principle, small firearms of the aforementioned design are known, the repeater loading process of which is carried out manually by the shooter and which are then simply called "repeater," "repeating weapon," or more precisely, depending on the design, "repeating gun," "repeating rifle," "repeating shotgun" or "repeating pistol."

In contrast, small firearms that are configured to perform the repeating action independently after firing are called "(partially) automatic" small firearms. Depending on the degree of automation, persons skilled in the art and, in most countries, legislators distinguish between "semi-automatic" small firearms, in which the trigger (operating element configured to fire the shot) of the small firearms must be released once and then pressed again before the next shot is fired, and "fully automatic" small firearms, in which at least one series of consecutive shots can be fired by a single pressing (and holding) of the trigger.

In principle, repeating weapons offer the advantage of not being dependent on an operating window that is required to carry out an (at least partially) automatic repeating process, a variable provided by the firing of a shot, such as a gas volume, a gas pressure, a (recoil) impulse or similar. For this reason, repeating weapons can be operated with a very wide range of different charges within the caliber intended for them.

However, the malfunction-free success of the repeating process is then dependent on the skill of the small firearm operator, which is to say, the shooter. A repeating process is usually divided into a succession of individual actions, the requirements and transitions of which the operator must then manage in such a way that no malfunctions occur in the operation of the small firearms.

In the case of (semi- and fully) automatic small firearms, the skill of the operator has no influence on the repeating process, however the automatic mechanism is usually only capable to a limited extent of dealing with a variance in the input variable required for its operation, for example, the aforementioned gas volume and/or gas pressure, or the (recoil) impulse, so that this type of small firearm—depending on the model—is configured for a more or less narrow operating window and consequently for a more or less narrow range of charges within the caliber intended for it.

It is therefore the state of the art and the generally accepted practice to provide active extractors for repeating firearms and passive extractors (at least for modern, which is to say, developed post-World War II) for constructions of (partially or fully) automatic small firearms. Extraction mechanisms that are configured to be dependent on the profile of the force path of the opening movement of the action are referred to as active extraction mechanisms, whereas extraction mechanisms that are independent of the profile of the force path are referred to as passive extraction mechanisms.

The possible range of charges within a caliber is in turn dependent on its own configuration. The main influencing factors are the volumes provided for the projectile and the propellant powder (which can influence each other if one of the two parameters varies), as well as the maximum permissible working gas pressure, the ability to influence the gas pressure distribution that depends on the geometric configuration of the combustion chamber of the case of the respective caliber and the likewise thereupon dependent minimum gas pressure that can be achieved under stable combustion conditions.

To achieve the volumes mentioned, it is possible to use cases and projectile diameter, case length and permissible cartridge length as well as the case shape as boundary conditions, wherein cylindrical, conical, and bottle-necked case types and combinations thereof with different design parameters (for example, shoulder angle and others) are known.

Against a background of small firearms being heat engines, efforts are made to achieve the highest possible efficiency, not only for economic reasons, but also for technical reasons of vibration and to achieve the highest possible operating comfort.

For this reason, for example, but often also due to the specifications determined by the geometric dimensions of the small firearms in question, cartridge calibers whose cases are relatively long are usually designed for long-barreled small firearms and cartridge calibers whose cases are relatively shorter are usually designed for short-barreled small firearms.

The person skilled in the art therefore distinguishes between long gun cartridges and handgun cartridges, depending on the original design purpose, even if these boundaries are sometimes blurred, and there are known long guns which are configured for handgun cartridges and vice versa.

Thus, for various reasons, it may be desired that small firearms whose design is originally set up for a (cartridge) caliber that has a relatively long cartridge case should be modified in such a way that a (cartridge) caliber that has a relatively short cartridge case can also be fired from it.

For example, the gun models mentioned above have been introduced as semi-automatic and/or fully automatic versions by various authorities around the world. These authorities often need to be able to train shooters, which is to say, police officers or soldiers, using inexpensive ammunition, whereby the basic handling of the training weapon should be as similar as possible to that of the operational weapon. In addition, the semi-automatic variants of the models mentioned above are often also popular sporting weapon models. The AR-15 type model is arguably the platform for the most popular sporting rifle model in the world today.

In order to transform such gun models or model types, such as the aforementioned AR-15 type or the G36 model, which, by way of example, are set up for the calibers 5.56 mm×45 mm NATO or alternatively .223 Remington or 7.62 mm×51 mm NATO or .308 Winchester, in such a way that a "practice cartridge" such as the small caliber cartridge .22 lfB (also called .22 LR) or large caliber handgun cartridges such as the 9 mm×19 mm (also called 9 mm Luger or 9 mm Para) or such as the .45 ACP, the .40 S&W, the 10 mm Auto, the .357 SIG or others, can be fired, it is known from the state of the art to replace their locked rotary bolt head with simple blowback action, whereby these gun models can be classified as semi-automatic small firearms and can be operated accordingly.

However, debates have now become known according to which individual governments are planning to ban civilian sport shooters from having access to semi-automatic small firearms, especially semi-automatic guns.

What is needed in the art is further reducing the susceptibility of the aforementioned small firearm type to malfunction. What is also needed in the art is a way of setting up existing gun models for practice cartridges and, in particular, achieving a high degree of equivalence in operation and functional reliability to the respective original model.

SUMMARY OF THE INVENTION

The present invention relates to a small firearm extending along a longitudinal direction, a width direction and a height direction, including: a receiver, a barrel having a barrel bore axis, an action having a bolt head, wherein the receiver is configured to at least indirectly receive the barrel including one locking mechanism area, one chamber, one guide area and one muzzle arranged one after the other in the longitudinal direction, as well as to at least indirectly receive the action movably arranged within the receiver along the longitudinal direction from an open position to a closed position and which action includes the bolt head, wherein the bolt head includes a breech face, an extractor, an ejector and at least one locking piece with at least one locking surface, wherein the locking mechanism area includes at least one bearing surface with which the at least one locking surface can be brought into contact in the closed position, wherein the locking mechanism area moreover includes a locking space within which the at least one locking piece can be moved from an unlocked position to a locked position in the region of the closed position. The invention also relates to a method for operating small firearms.

The present invention provides that at least one of the aspects mentioned is achieved in small firearms of the aforementioned type in that a guide surface is provided within the locking space, by way of which guide surface the entry of a cartridge case, during the movement of the action from the closed position to the open position is under the influence of a torque, is limited due to the interaction of the ejector and extractor and/or the exit of the cartridge case is favored.

In other words, if the guide surface is configured to promote the exit of the cartridge case from the locking space, it is configured in such a way that an exit process of the cartridge case is supported and, for this purpose, the cartridge case is optionally acted upon by a (reaction) force during its joint movement with the action when contact is made with the guide surface, which exerts an influence (which is relevant in practice) on the exit movement of the cartridge case.

In a broad interpretation, it should be irrelevant for the assessment of the subject matter of the property right whether the locking mechanism area is actually integral with the barrel or forms part of the receiver (or more precisely the receiver part) to which the barrel is connected. What is important is the observance of the arrangement of the locking mechanism area, chamber, guide area and muzzle one after the other in the longitudinal direction.

According to a much narrower, more specific interpretation of the subject matter of the property right, this sequence can indeed be formed within the barrel.

The locking space is occasionally also referred to by the person skilled in the art as "movement space," inasmuch as the locking pieces can be moved from an unlocked position to a locked position within this space. It goes without saying that this space, which is to say, the locking space or the movement space, does not need to be completely defined by materially existing boundaries, but rather is configured, in practice, as a space that is open, at least over a section of its circumference. Such an imaginary boundary can optionally be formed by the projection of the lateral surface of the diameter $D_1$ of the chamber, which is to say, the diameter of the cartridge case seating area of the chamber in its root area. Further boundaries defining the locking space or movement space can be formed by the edge area of the locking space. Starting from an extension of the barrel bore axis, these then lie radially outside the imaginary boundary described.

The fact that a guide surface is provided within the locking space, by way of which guide surface the entry of a cartridge case which during the movement of the action from the closed position to the open position is under the influence of a torque is limited due to the interaction of the ejector and extractor and/or the exit of the cartridge case is favored, at least significantly reduces, in particular eliminates, the significance of a possible source of interference that can influence the operation of small firearms.

It is true that the risk of increased susceptibility to malfunction due to the possible or actual entry of a cartridge case (for this purpose, it is evident that the cartridge case does not need to fully enter the locking mechanism area, but rather, in this case, this means the penetration of at least one area of a cartridge case, in particular the nose area) has not yet been generally recognized, as this problem can usually be circumvented (at least sufficiently) by constructive design of the boundary conditions during configuration of a specific gun model.

If such a model is then to be reconfigured for a practice cartridge, extensive adaptations are usually made, and as a rule completely different action systems are used, which is noticeable in many aspects of the handling of the small firearms for the shooter.

The inventors have, however, recognized, that by providing a guide surface within locking spaces, by way of which guide surfaces the entry of a cartridge case which during the movement of the action from the closed position to the open position is limited due to the interaction of the ejector and extractor and/or the exit of the cartridge case is favored, an aspect that has been practically ignored up until now and which can lead to a source of malfunction can be excluded.

As a result, significantly fewer design adaptations are required for the adaptation for other calibers of an existing weapon model, so that, for example, different individual components or assemblies can be used in different caliber-specific embodiments of the respective weapon model, so that a significant economic aspect of the present invention also results.

The guide surface is advantageously configured and arranged in such a way that the entry of a cartridge case under the influence of a torque during the movement of the action from the closed position to the open position is directly limited due to the interaction of the ejector and extractor and/or the exit of the cartridge case is directly favored. It is further optional that the direct limitation and/or the direct favoring is generated by direct contact between the guide surface and the cartridge case (or, depending on the case, if the shot is not fired possibly also the projectile fixed inside the cartridge case). It is optional that the bottom end face (the so-called cartridge base) remains free of any contact with the guide surface. Rather, a direct contact between the guide surface and the muzzle area of the cartridge case can be (temporarily) formed, by way of which the entry of a cartridge case under the influence of a torque during the movement of the action from the closed position to the open position is directly limited due to the interaction of the ejector and extractor and/or the exit of the cartridge case is directly favored. The immediate, which is to say, direct, limitation of the entry and/or immediate, which is to say, direct, favoring of the exit temporarily creates a comparably rigid system, so that repeatable and defined circumstances are created for the subsequent ejection of the cartridge case. This makes it possible to positively influence the functional reliability of a downstream process step in the shot barrel. In addition, a direct (immediate) influence is also dependent on a smaller number of external influences.

It can therefore be advantageous if the small firearm is configured in such a way that the chamber has a length, in particular a total length of the cartridge case seating area of the chamber, and a diameter, in particular a diameter of the cartridge case seating area of the chamber in its root area, whose quotient is a dimensionless quantity between 0.66 and 3.75, optionally between 0.66 and 3.66, more optionally between 0.99 and 3.33, even more optionally between 1.0 and 3.0, most optionally between 1.41 and 2.42, and most particularly optionally between 1.41 and 2.22.

The dimensions of approved cartridges (more precisely: unitary cartridges, but referred to here as cartridges), cartridge cases, and the chamber design to be provided on the weapon side are standardized and defined by the C.I.P. (COMMISSION INTERNATIONALE PERMANENTE POUR L'EPREUVE DES ARMES A FEU PORTATIVES, headquartered in Brussels). The relevant length here, designated "$L_3$," always refers to the total length of the cartridge case seating area of the chamber when referring to the geometric definition of a chamber. Furthermore, in the same context, the diameter designated "$D_1$," which is relevant here, always refers to the diameter of the cartridge case seating area of the chamber in its root area. The person skilled in the art is familiar with this designation system, and, in this respect, reference is also made to the C.I.P. publications.

These results were surprisingly ascertained through experiments.

It is assumed that small firearms of the aforementioned type benefit in particular from the effects that can be generated by the guide surface when set up for cartridges with a quotient between 1×root 2 and 2×root 2 and an accordingly configured chamber. Significant deviations have, however, also occurred in the tests, so that advantages were also recognized with quotients of less than root 2, up to about one and a half times root 2 and upwards almost to three times root 2, but with a certain clarity at least up to about two and a half times root 2.

It should be noted that the distance from the ejection device to the barrel bore axis increases with increasing diameter $D_1$, as does the distance of the pressure point of the ejector acting on the base of the cartridge (case) and, as a result, the effective lever firearms for generating the torque. However, the grip surface available to the extractor increases with increasing diameter $D_1$, which is why the (spring) forces can be reduced.

In certain cases, it can be advantageous if the small firearm is configured as a repeating weapon, in particular as a repeating gun, namely a repeating rifle or repeating shotgun, or as a repeating pistol.

In this way, it is also possible to make very extensive use of, for example, the ballistic range of practice cartridges, on top of which, the combination of features described in connection with the design as a repeating weapon results in synergistic effects in achieving particularly low malfunction rates. In the first stage of movement, the shooter experiences multiple changes in force on the operating element by way of which they control the repeating process, usually called bolt handle or loading lever, from which they must nevertheless independently ensure that the movement of the action and the repeating mechanism is as uniform as possible. The fact that a guide surface is now provided on which the cartridge case under torque (or, if no shot has been fired, the entire cartridge to be removed) is supported in a defined manner or alternatively can slide along it makes it easier for the operator (the shooter) to control the repeating process, in particular the opening part of the repeating process, which ultimately also reduces the susceptibility to malfunction.

On the other hand, in other cases, it may be optional for the small firearms to be configured as a (partially) automatic small firearm, in particular as a semi-automatic and/or fully automatic small firearm.

Although the focus here is not on increasing functional safety by providing support and thus improving ease of use, (semi-)automatic small firearms are inherently exposed to a higher risk of malfunction, especially if they are operated at an edge area of their operating window (which is dependent on the charge). In particular, if the action speeds (and the acting acceleration gradient) are relatively low, movement amplitudes of a cartridge case (or the entire cartridge to be removed if no shot has been fired) under torque, but also under the influence of its own inertia, can be greater due to the additional time and thus have a greater influence on the movement sequence. If this were to cause irregularities to occur, the cartridge case can, for example, be released prematurely from the catch between the extractor and ejector and then cause the small firearm to jam, for example, by collision with a cartridge following it.

In conjunction with a view to generate a reflection of the firing behavior acting on the operator of a similar weapon model of an energetically stronger caliber, in particular a long rifle caliber, experiments have surprisingly shown that the use of a locked action system with integrated ejection device made possible by the present invention is particularly advantageous if the (semi-)automatic repeating process takes place by way of a direct gas extraction (DGI system). To a somewhat lesser extent, this also applies to a piston system, which in a normal case (which is to say, when using more energetic (long gun) ammunition) is known to be more comfortable to shoot than a DGI system under normal conditions. It is assumed that, in combination with the large number of parameters involved, there is a kind of compensation here, especially if the weapon models to be compared are represented by a standard M 15 model using .223 Remington and a weapon model configured with a 9 mm Para or .45 ACP caliber.

Irrespective of this, it may also be optional for the guide surface to be rigid and, in particular, to be part of a block arranged within the locking space.

In this way, no additional moving parts are required in the small firearm, and additional potential sources of malfunction are suppressed. In addition, such a further development can offer economic advantages, for example, through the ability of being integrated inexpensively into the manufacturing process and due to the expected low additional costs.

A rigid design can also include implementations that are inherently deformable. In particular, the block can be formed using a material that exhibits measurable and, in particular, visible deformations when the forces acting on the block during operation of small firearms are applied. This can have a damping effect on undesired movements (vibrations) of at least individual parts or assemblies in motion during the repeating process of the small firearms.

In a stricter sense, a rigid guide surface, in particular a rigid block forming the guide surface, can be understood as a component that does not exhibit any measurable and in particular no visible deformations under the forces acting on the guide surface/block during operation of small firearms. For this purpose, it may be particularly optional for the block to be formed using a steel the surface of which is optionally hardened and/or provided with a wear-reducing coating.

In turn, in other cases, it may be optional that the guide surface is arranged and/or configured to be movable, in particular movable within the locking space.

This may for example, be optional if space is temporarily required during the extraction process or during another section of the repeating process due to the geometric design of the locking space.

Such a design can also be advantageous if the locking surface is intended to perform a first task in a first position and a second task in a second position and, in particular, if the first and second tasks differ from one another.

It can be advantageous if the guide surface can be moved against a spring force from a rest position to a deflected position.

This ensures, on the one hand, that within each firing sequence, the guide surface reaches a defined position in its rest position at least once, even if a certain degree of contamination has built up inside the small firearm, for example during operation of the small firearm.

On the other hand, the spring can serve as a temporary energy store so that the energy absorbed by the guide surface can be transferred to the cartridge case (or the entire cartridge to be removed if no shot has been fired) in a subsequent section of the repeating cycle and can therefore actively influence the movement profile of the cartridge case/cartridge to be ejected.

It may be optional for the guide surface to form at least part of an edge area of the locking space.

This can, for example, be optional if the guide surface is configured to at least also favor the exit of the cartridge case.

It may be particularly optional for the guide surface to form at least part of the at least one bearing surface in a first working position and to form the guide surface in a second working position.

It may be provided that the guide surface can be locked in at least one working position, in particular in the first working position.

In so doing, the guide surface can absorb forces occurring in the shot in the first working position in its function as a bearing surface and, after unlocking, can be arranged to be movable into the second working position in order to be configured there as a bearing surface, for example, to favor the ejection of the cartridge case. Such a design can, in particular, save installation space on the small firearm. In addition, the guide surface is available as a bearing surface in the first working position, so that the load occurring during firing does not need to be distributed to other bearing surfaces, resulting in further advantages, for example, in the possibility of caliber selection or the durability and operational safety of the small firearms.

It may be optional that the guide surface forms at least one angle $\alpha$ relative to the barrel bore axis in the range between −15° and +15°, optionally in the range between −7.5° and +7.5°, optionally around 0°.

In this way, a largely uniform movement profile of the cartridge case/cartridge to be ejected is achieved, especially if the guide surface is at least predominantly configured to limit the entry of the cartridge case/cartridge into the locking space.

Alternatively or additionally, it can be advantageous if the guide surface forms at least one angle $\beta$ relative to the barrel bore axis in the range between 12.5° and 65°, optionally in the range between 30° and 55°, optionally between 32° and 45° in the positive and/or negative direction.

Here, as for the specification of the angle $\alpha$ mentioned above, the positive direction should be defined following the clockwise direction and the negative direction following the counterclockwise direction when looking at the weapon in the direction of the muzzle of the barrel from above.

By providing an angle $\beta$ set up in this way, greater influences on the movement profile of the cartridge case/cartridge to be ejected are achieved, which is particularly useful if the guide surface is configured at least predominantly to favor the ejection of the cartridge case/cartridge from the locking space. The movement profile can thus be significantly deflected.

Furthermore, it can also be advantageous if the guide surface itself includes at least one angle $\gamma$.

In this way, graduations for limiting the entry and favoring the exit of a cartridge case/cartridge can be combined particularly well and particularly favorably in terms of production technology.

Alternatively or additionally, it can be advantageously be provided that the guide surface includes at least one curvature and optionally at least one turning point.

This is, indeed, significantly more complex in terms of manufacturing technology; it can, however, contribute to particularly smooth transitions of the movement profile of the cartridge case/cartridge to be ejected and thus to a particularly "fluid" sequence of the entire repeating process and thus, ultimately, in the case of the design of the small firearms as a repeating weapon, increase the operating comfort and generally the functional reliability of the small firearms.

It is provided, with great advantage, that the guide surface provided within the locking space is configured and arranged in such a way that, the entry of a cartridge case which during the movement of the action from the closed position to the open position is limited due to the interaction of the ejector and extractor to a maximum of 0.8 times the diameter $D_1$, optionally at most 0.65 times, optionally at most 0.5 times, optionally at most 0.33 times, optionally at most 0.25 times and optionally at most 0.15 times the diameter $D_1$ of the cartridge case seating area in its root area.

These results were surprisingly ascertained through experiments.

It can be assumed that smaller factors are particularly advantageous, but it remains inexplicable why the advantageous effects appear to increase in an almost parabolic fashion upon a drop below 0.45 times the value of the diameter $D_1$. In any case, from this point onwards there is a completely unexpected departure from a "linear" improvement in the sequence with further locking of the factor. It also appears to be advantageous if a certain degree of freedom to penetrate the locking space is maintained. Thus, it appears to be advantageous if a penetration of at least 0.01 times the value of the diameter $D_1$, optionally at least 0.02 times the value of the diameter $D_1$, optionally at least 0.03 times the value of the diameter D is possible. A constant reduction of the factor obviously therefore does not achieve the goal, so that there remains a certain lack of clarity as to the reasons for the particularly advantageous value ranges resulting under different boundary conditions.

Alternatively or additionally, it can also be provided with great advantage that the guide surface provided within the locking space is configured and arranged in such a way that the exit of a cartridge case, which has entered the locking space during the movement of the action from the closed position to the open position due to the interaction of the ejector and extractor under the influence of the cartridge case under torque, is at least 0.5 times, optionally at least 0.7 times, optionally at least 0.8 times, optionally at least 0.9 times the amount of the entry; in other words, the return path is favored, in particular, supported by contact.

These results were surprisingly ascertained through experiments.

It can be assumed that larger factors are particularly advantageous, but it remains inexplicable why the advantageous effects appear to increase in an almost parabolic fashion when exceeding 0.66 times the value of the diameter $D_1$. In any case, from this point onwards there is a completely unexpected departure from a "linear" improvement in the sequence with further locking of the factor. It also appears to be advantageous if a certain amount of (residual) travel remains unsupported when the cartridge case/cartridge exits. It therefore appears to be advantageous if, for example, the exit is at least 0.01 times the value of the diameter $D_1$, optionally at least 0.02 times the value of the diameter $D_1$, and optionally at least 0.05 times the value of the diameter $D_1$ without support, which is to say, without the influence of the guide surface. Even according to this, a constant increase in the factor obviously does not lead to the goal, so that a certain lack of clarity remains as to the reasons for the particularly advantageous value ranges resulting under different boundary conditions.

In certain cases, it can be advantageous if the action is arranged within the receiver so as to be movable along the longitudinal direction and the bolt head is arranged in the action so as to be rotatable about an axis of rotation extending in the longitudinal direction.

In this context, particularly strong positive effects have been observed with a configuration of the small firearm according to the present invention.

In other cases, on the other hand, it may be optional if the action is arranged within the receiver so as to be movable along the longitudinal direction and the bolt head is firmly connected to the action and optionally arranged in the receiver so as to be rotatable together with the action about an axis of rotation extending in the longitudinal direction.

In certain cases, it may be optional for the bolt head to include locking lugs.

In other cases, on the other hand, it may be optional for the action to include a movably arranged locking block and, in particular, to be configured as a breech block action.

Also in these contexts, particularly strong positive effects were observed with a configuration of the small firearm according to the present invention.

It may also be optional for the action, and in particular the bolt head, to be configured as an expanding head lock.

Also in these contexts, particularly strong positive effects were observed with a configuration of the small firearm according to the present invention.

It may be optional in certain cases for the small firearm to be configured as a long gun, in particular as a rifle.

This results in advantages both for official training purposes and for sporting use.

In other cases, on the other hand, it may be optional for the small firearms to be configured as handguns.

This results in advantages both for official training purposes and for sporting use.

The present invention also provides a method for operating small firearms, wherein a small firearm as described above is used when operating the small firearms.

The resulting advantages are apparent to the person skilled in the art from the description of the advantages of the small firearms and their optional configurations and are not repeated here for reasons of economy.

In the following, an optional configuration of the present invention is explained in more detail with reference to the figures of a single drawing. The description of the optional configuration should by no means be regarded as complete and exhaustive.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1A:
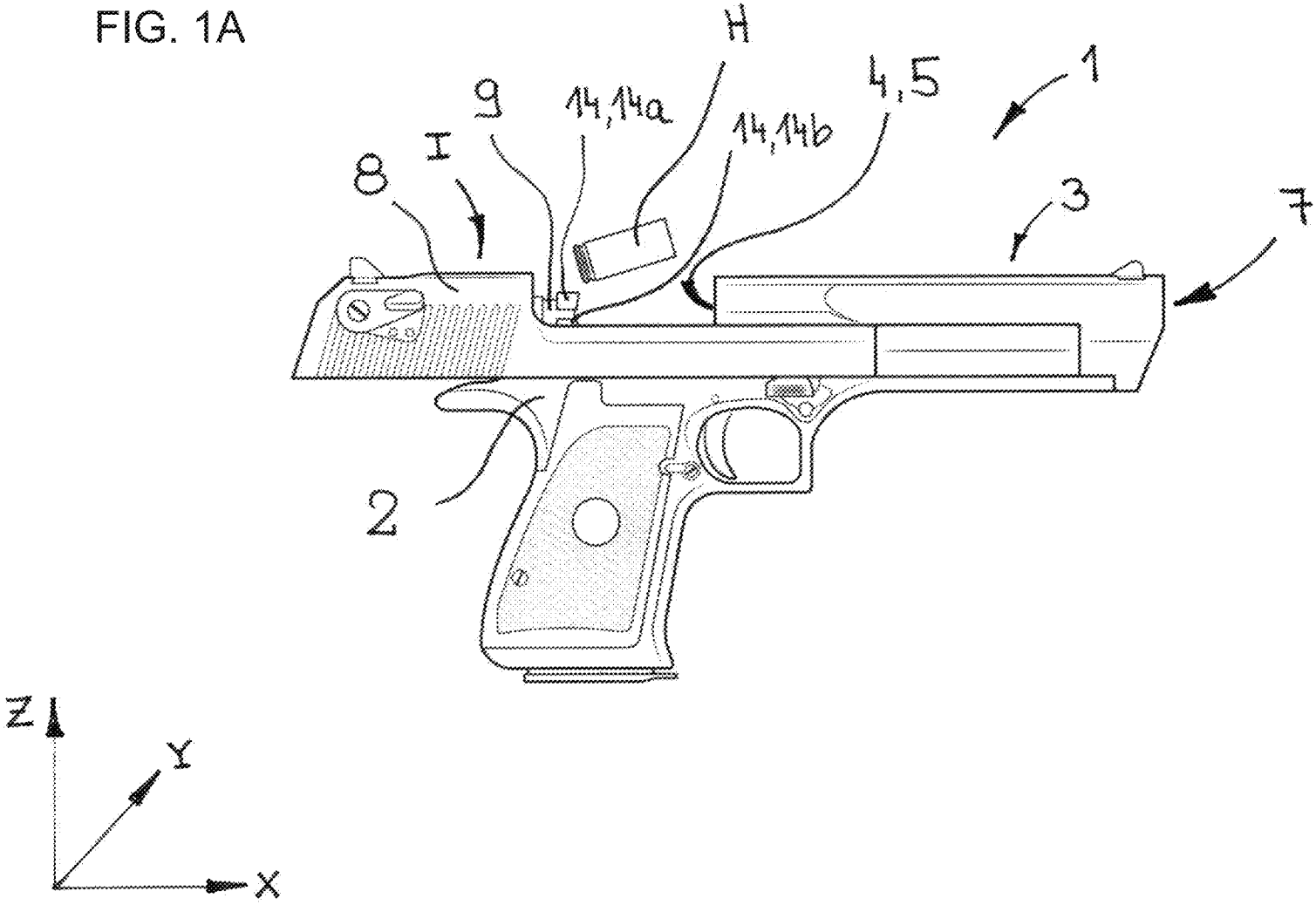
FIG. 1A shows a right side view of a small firearm configured as a semi-automatic pistol ("self-loading pistol")

The drawing with the thirteen FIGS. 1A through 8 shows a single optional embodiment example of a small firearm according to the present invention. Identical components are given the same reference sign in all figures and need not be shown or visible in all figures or (re)described in connection with each individual figure.

In the drawing, FIG. 1A shows a right side view of the small firearm 1, which is configured as a semi-automatic pistol and extends along a longitudinal direction X, a width direction Y and a height direction Z, including:

a receiver 2, 2*a*, 2*b* a barrel 3 with a barrel bore axis A an action 8 with a bolt head 9, wherein the receiver 2 is configured to at least indirectly receive the barrel 3 including one locking mechanism area 4, one chamber 5, one guide area 6 and one muzzle 7 indicated in the figure, arranged one after the other in the longitudinal direction X, as well as to at least indirectly receive the action 8 movably arranged within the receiver 2 along the longitudinal direction X from an open position I to a closed position II not shown and which action 8 includes the bolt head 9, wherein the bolt head 9 includes a breech face 11, as well as an extractor 12 and an ejector 13 not recognizable in this view and at least one locking piece 14, 14*a*, and 14*b* with at least one locking surface 15, 15*a* and 15*b*, wherein the locking mechanism area 4 in a not visibly represented form includes at least one bearing surface 16, 16*a* through 16*f*, with which the at least one locking surface 15, 15*a* and 15*b* can be brought into contact in the closed position II, wherein the locking mechanism area 4 moreover includes a locking space R, within which the at least one locking piece 14, 14*a* through 14*f* can be moved from an unlocked position III to a locked position IV in the region of the closed position II, and wherein furthermore within the locking space R, not visible in this figure, a guide surface 17 is provided, by way of which the entry of a cartridge case H, which is under torque M during the movement of the action 8 from the closed position II to the open position I is limited due to the interaction of ejector 13 and extractor 12, and/or the exit of the cartridge case H is favored.

Figure 1B:
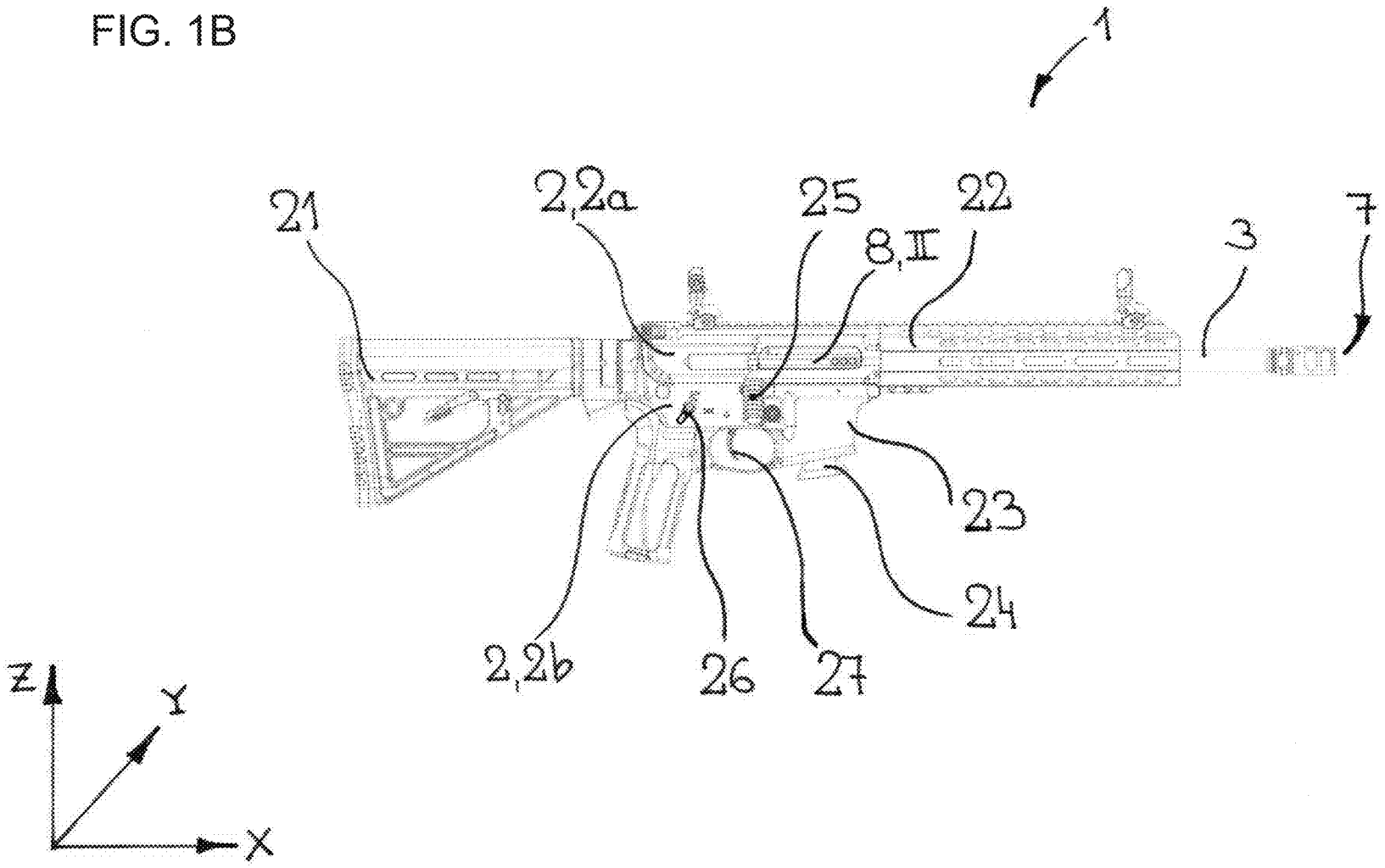
FIG. 1B shows a right side view of a small firearm configured as a bolt action rifle.

FIG. 1B shows a right side view of the small firearm 1 configured as a repeating rifle, which is described in more detail in the other FIGS. 2 through 9 with various perspective and cross-sectional views and the contents of which can also be transferred analogously to small firearms configured according to FIG. 1A.

The small firearm 1 shown in FIG. 1B, which extends along a longitudinal direction X, a width direction Y and a height direction Z, includes:

a receiver 2, 2*a*, 2*b* a barrel 3 with a barrel bore axis A an action 8 with a bolt head 9, wherein the receiver 2 is configured to at least indirectly receive the barrel 3 including one locking mechanism area 4, one chamber 5, one guide area 6 and one muzzle 7 indicated in the figure, arranged one after the other in the longitudinal direction X, wherein individual positions are only shown and/or designated in the later FIGS. 2 through 8. The receiver 2, 2*a*, 2*b* is also configured to at least indirectly receive the action 8, which is arranged within the receiver 2, 2*a*, 2*b* so as to be movable along the longitudinal direction X from an open position I to a closed position II, which is shown here, and which includes the bolt head 9, wherein the bolt head 9 includes a breech face 11, an extractor 12, an ejector 13 and at least one locking piece 14, 14*a* through 14*f* with at least one locking surface 15, 15*a* through 15*f*, wherein the locking mechanism area 4 includes at least one bearing surface 16, 16*a* through 16*f*, with which the at least one locking surface 15, 15*a* through 15*f* can be brought into contact in the closed position II, wherein the locking mechanism area 4 further includes a locking space R, within which the at least one locking piece 14, 14*a* through 14*f* can be moved from an unlocked position III to a locked position IV in the region of the closed position II, and wherein, moreover, a guide surface 17 is provided within the locking space R, by way of which the entry of a cartridge case H under torque M during the movement of the action 8 from the closed position II to the open position I is limited due to the interaction of the ejector 13 and extractor 12 and/or the exit of the cartridge case H is favored.

FIG. 1B also shows a butt stock 21 and a fore-end 22, which are connected to the small firearm 1 and in this way in particular form part of the small firearm 1. Furthermore, the magazine well 23 is shown as part of the lower receiver 2*b*, in which magazine well a magazine (cartridge magazine) 24 is fixed, which magazine serves to temporarily store the cartridges P to be removed from it by the action 8 (in particular the bolt head 9) during the repeating cycle and fed into the chamber 5 of the barrel 3.

Also visible is the operating element 25, which the operator (shooter) can use to control the repeating process and which is also called the "loading lever" or "bolt handle."

Finally, in addition to other, unmarked elements of the small firearm 1, the safety 26, or rather its selector element, which acts on a lock mechanism arranged inside the receiver 2 and not shown in detail here, and the trigger 27 to be actuated to release the shot are also shown.

Figure 2:
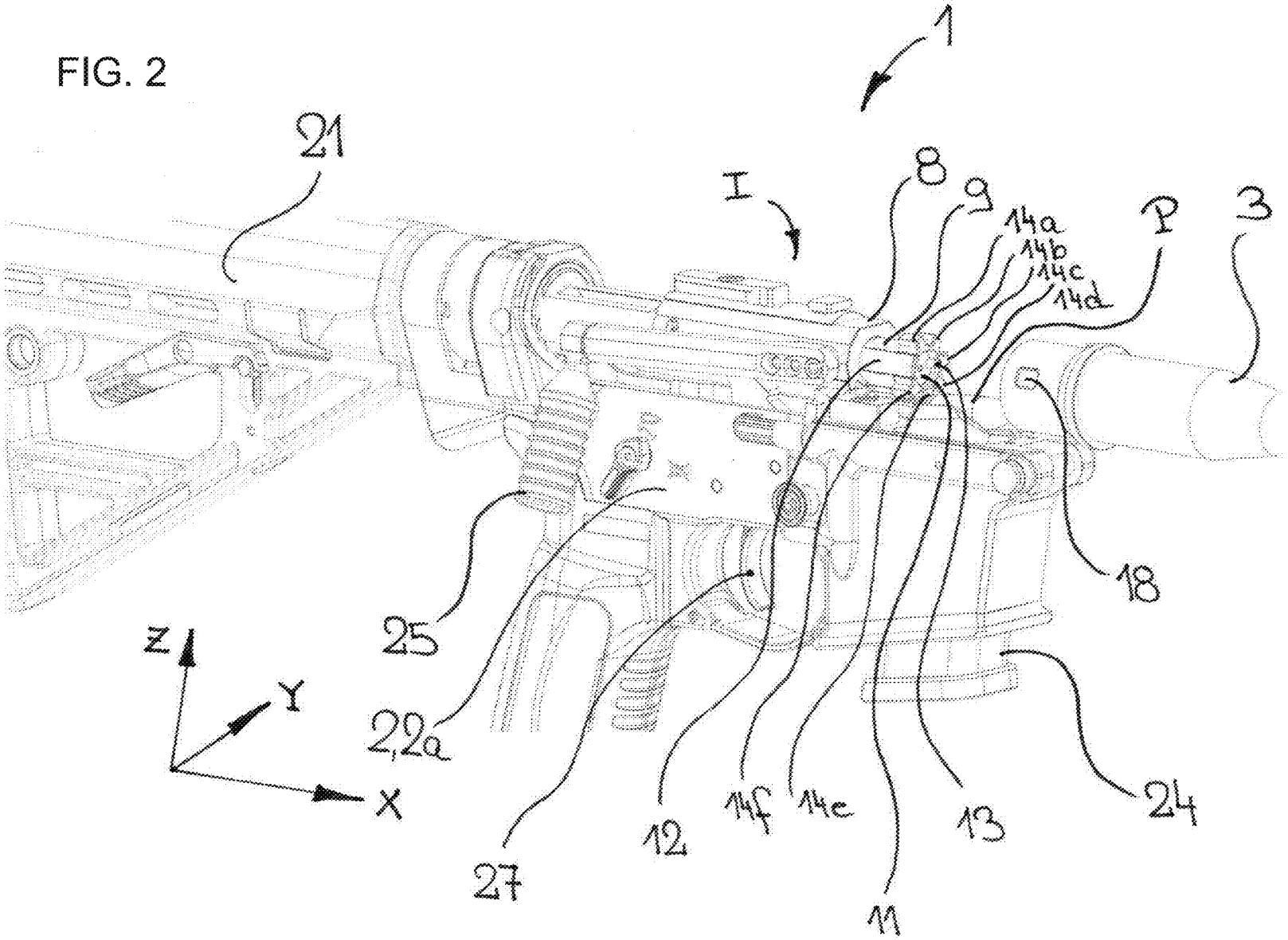
FIG. 2 shows a perspective view of the small firearm with the action open and the upper receiver part not shown for a better visibility.

FIG. 2 shows the small firearms 1 in a first perspective view. In order to better illustrate and explain the internal functions of the small firearms 1, the upper receiver part is blanked out so that there is a clear view of the action 8 with the bolt head 9. In the exemplary embodiment, the bolt head 9 has a locking piece 14 with six locking pieces 14*a* through 14*f*. The illustration also provides a good view of the breech face 11, as well as of the ejector 13 and the extractor 12, which, after later removal of the cartridge P, which is here still in the magazine 24, exert a torque M on the cartridge P, which is supported by its base on the breech face 11.

The view further provides a view of the rear side of the block 18, the front side of which protrudes into the locking space 4, which is not yet recognizable here, and forms the guide surface 17.

It can also be seen that the action 8 is arranged within the receiver 2, 2*a*, 2*b* so as to be movable along the longitudinal direction X and that the bolt head 9 is arranged in the action 8 so as to be rotatable about an axis of rotation 10 extending in the longitudinal direction.

Figure 3:
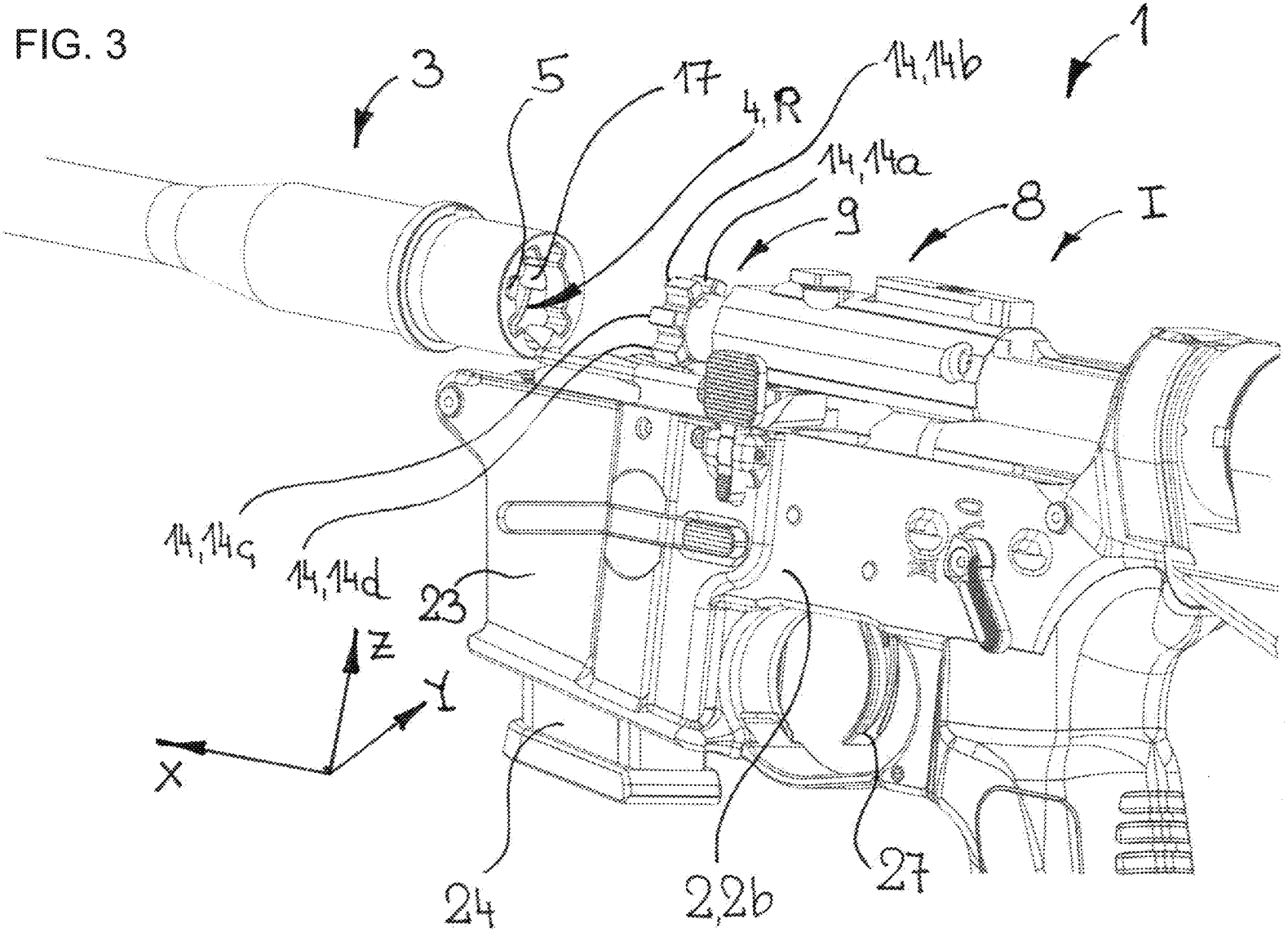
FIG. 3 shows a further perspective view of FIG. 2.

FIG. 3 shows another perspective view of the small firearm 1. In order to better illustrate and explain the internal functions of the small firearms 1, the upper receiver part is also blanked out here, so that in addition to the unobstructed view of the action 8 with the bolt head 9, there is now also a view into the locking space 4 and an edge area of the chamber 5 adjoining it in the muzzle direction.

The bearing surface 17 arranged in the locking space R of the locking mechanism area 4 is clearly visible.

Figure 4:
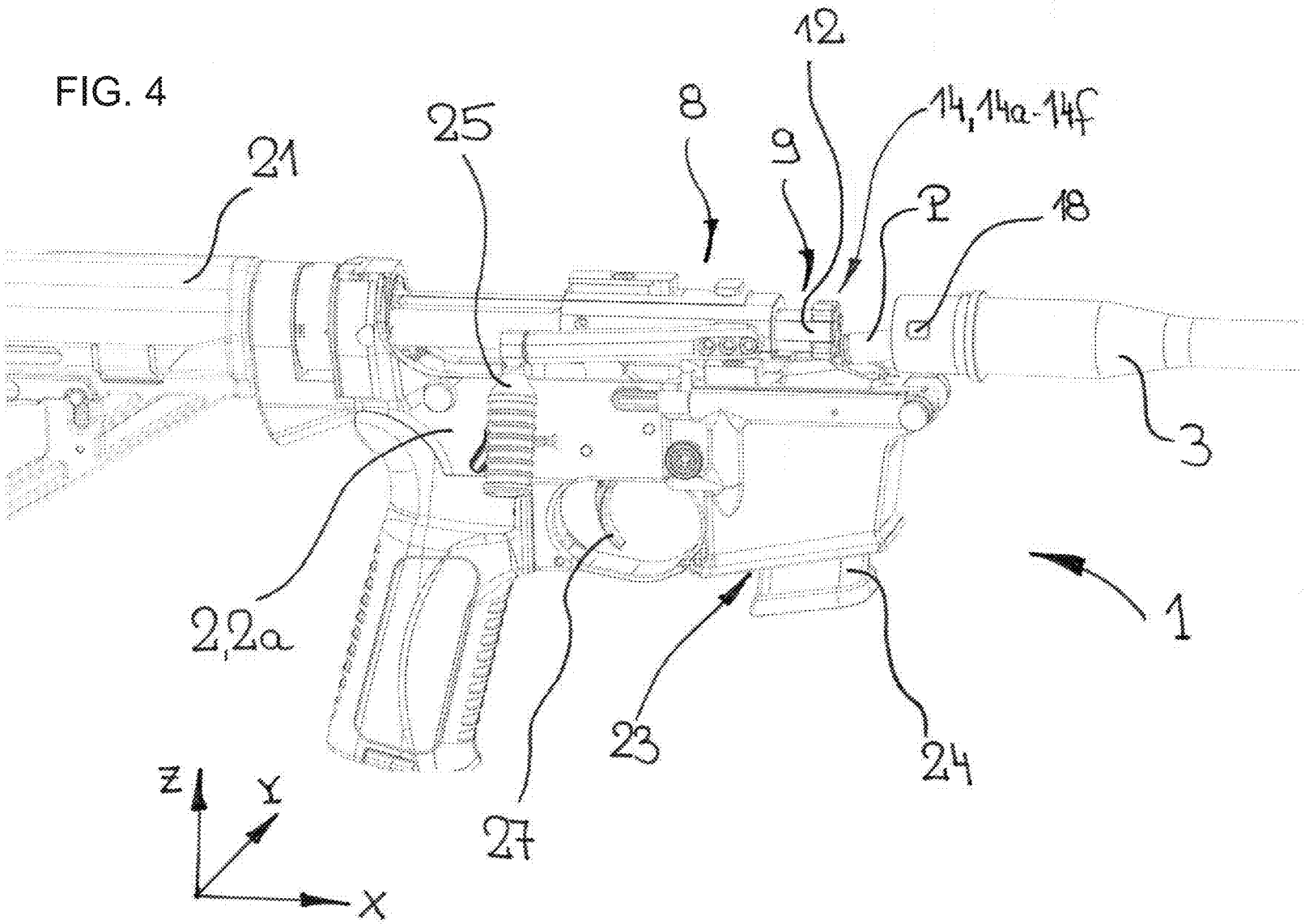
FIG. 4 shows a perspective view of the closing movement of the action with removal of a cartridge from the magazine ("cartridge feed")

FIG. 4 shows the small firearm 1 in a further perspective view, in which the action 8 with the bolt head 9 for feeding a cartridge P into the chamber 5 of the barrel 3 is illustrated in a movement from an open position I, as shown in particular in FIG. 2 and FIG. 3, to a closed position II shown in the following figures and, for example, in FIG. 1B.

Figure 5:
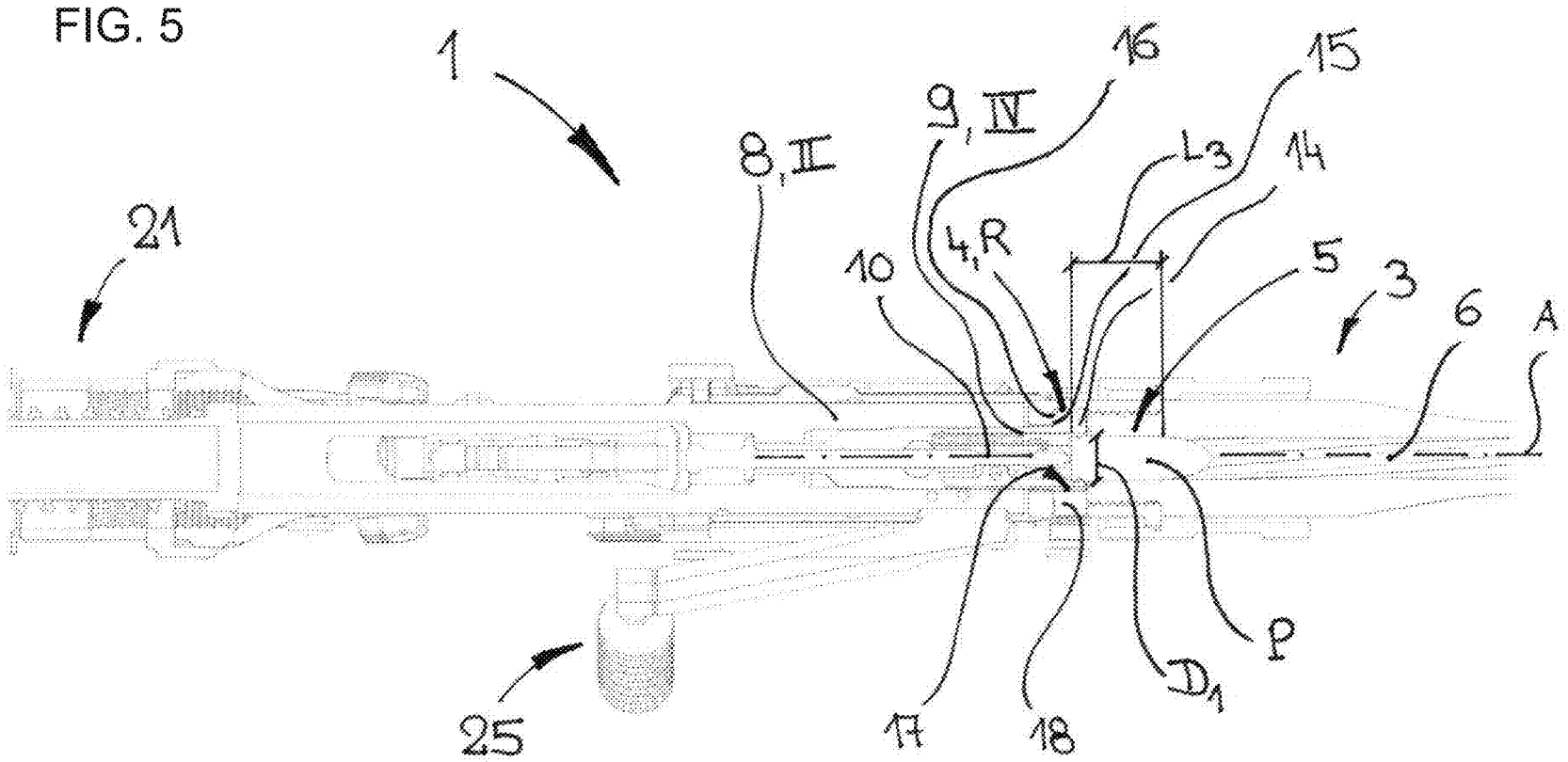
FIG. 5 shows a top view of a cross-sectional representation of the small firearm with closed action and cartridge in the chamber of the barrel (before firing) in a first embodiment.

FIG. 5 now shows the top view of a cross-sectional view of the small firearm 1 with closed action 8 (which is to say, the action is in closed position II) and the cartridge P located in the chamber 5 of the barrel 3 (before firing) in a first embodiment in which the bearing surface 17 is formed by a block 18 projecting into the locking space R of the locking mechanism area 4 and arranged within the locking mechanism area 4. The block 18 is rigid and can be formed using a material that exhibits measurable and, in particular, visible deformations under the forces acting on the block during operation of a small firearm 1. Even if it is not immediately apparent from the illustration, the block 18 shown here should be understood as a component that shows no measurable and in particular no visible deformations under the forces acting on the guide surface/block during operation of a small firearm 1. For this purpose, the block is formed using a steel, the surface of which is optionally hardened and/or provided with a wear-reducing coating.

The block 18 can be replaceable or, as is to be assumed here, firmly connected to the barrel 3 of the small firearm 1.

The chamber 5 has a diameter $D_1$, which indicates the diameter of the cartridge case seating area in its root area, and a length $L_3$, which indicates the total length of the cartridge case seating area of the chamber, and is formed in an axial symmetrical manner about the barrel axis A, in the alignment of which the axis of rotation 10 of the bolt head 9 is also arranged.

The bolt head 9 is in a locked position IV in which the locking surfaces 15 (15*a* through 15*f*) of the locking pieces 14 (14*a* through 14*f*) are in operational contact with the associated bearing surfaces 16 (16*a* through 16*f*).

In longitudinal direction X, the barrel 3 includes the locking mechanism area 4 with the locking space R, the chamber 5, the guide area and the muzzle 7, which muzzle is only visible in other figures.

The chamber 5 is configured in such a way that its length $L_3$, which is to say, the total length of the cartridge case seating area of the chamber 5, and the diameter $D_1$, which is to say, the diameter of the cartridge case seating area of the chamber 5 in its root area, form a dimensionless quotient between one times root two and two times root two. Accordingly, the quotient lies in a broadly defined range between 0.66 and 3.66, optionally between 1.0 and 3.0 and optionally between 1.41 and 2.22.

Figure 6A:
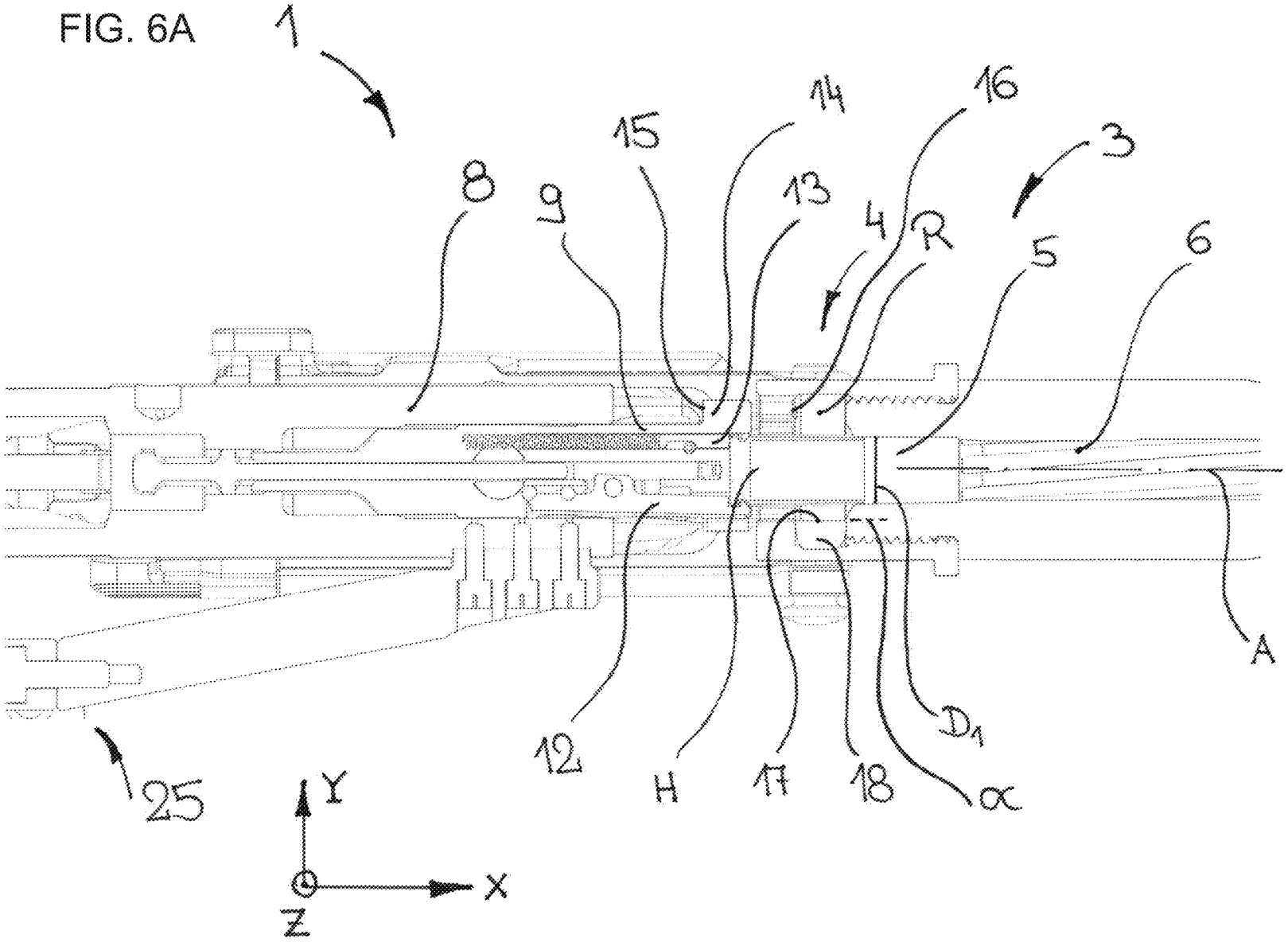
FIG. 6A shows a top view of a cross-sectional representation of the small firearm with partially opened action and cartridge case still partially in the chamber of the barrel (immediately after the shot) in the first embodiment.

FIG. 6A likewise shows a top view of a cross-sectional view of the small firearm 1 with the action 8 now slightly open and the cartridge case H already partially released from the chamber 5 after firing the cartridge P from the previously described figure in the first embodiment in which the bearing surface 17 is protruding into the locking space R of the locking mechanism area 4 and arranged within the locking mechanism area 4.

The bearing surface has an angle $\alpha$ relative to the barrel bore axis A, which is 0° or at least close to 0°. In other words, the bearing surface 17 and the barrel bore axis are approximately parallel, at least in this cross-sectional view, even if the bearing surface 17 does not necessarily need to be flat, but rather can also curve in an axial symmetrical manner about the barrel bore axis in the shape, for example, of a ring section. In any case, the angle α here is in a range between −15° and +15° and also within an optional range between −7.5° and +7.5°.

Figure 7:
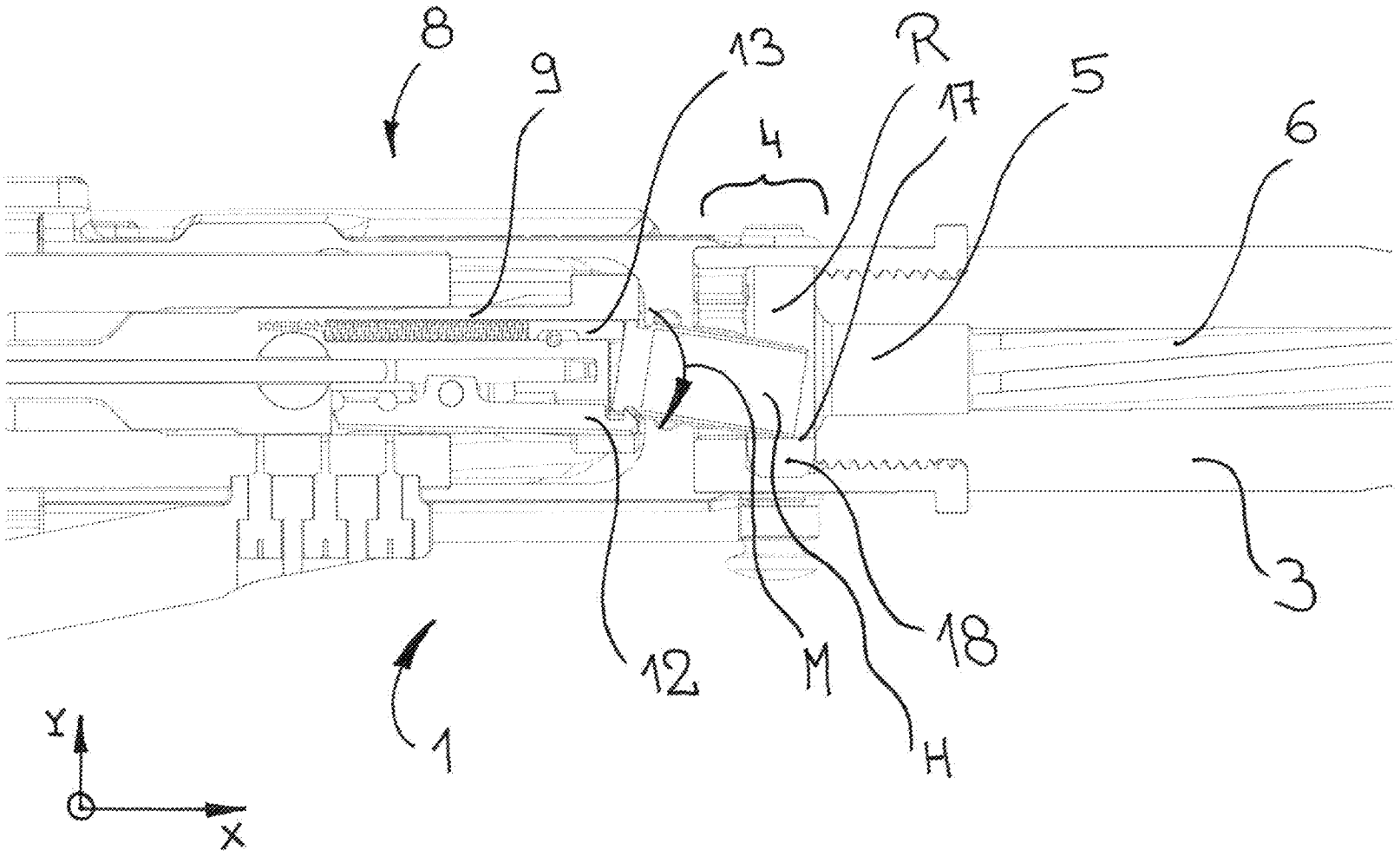
FIG. 7 shows a top view of an otherwise identical cross-sectional representation of the small firearm with the action open in a first stage.
Figure 8:
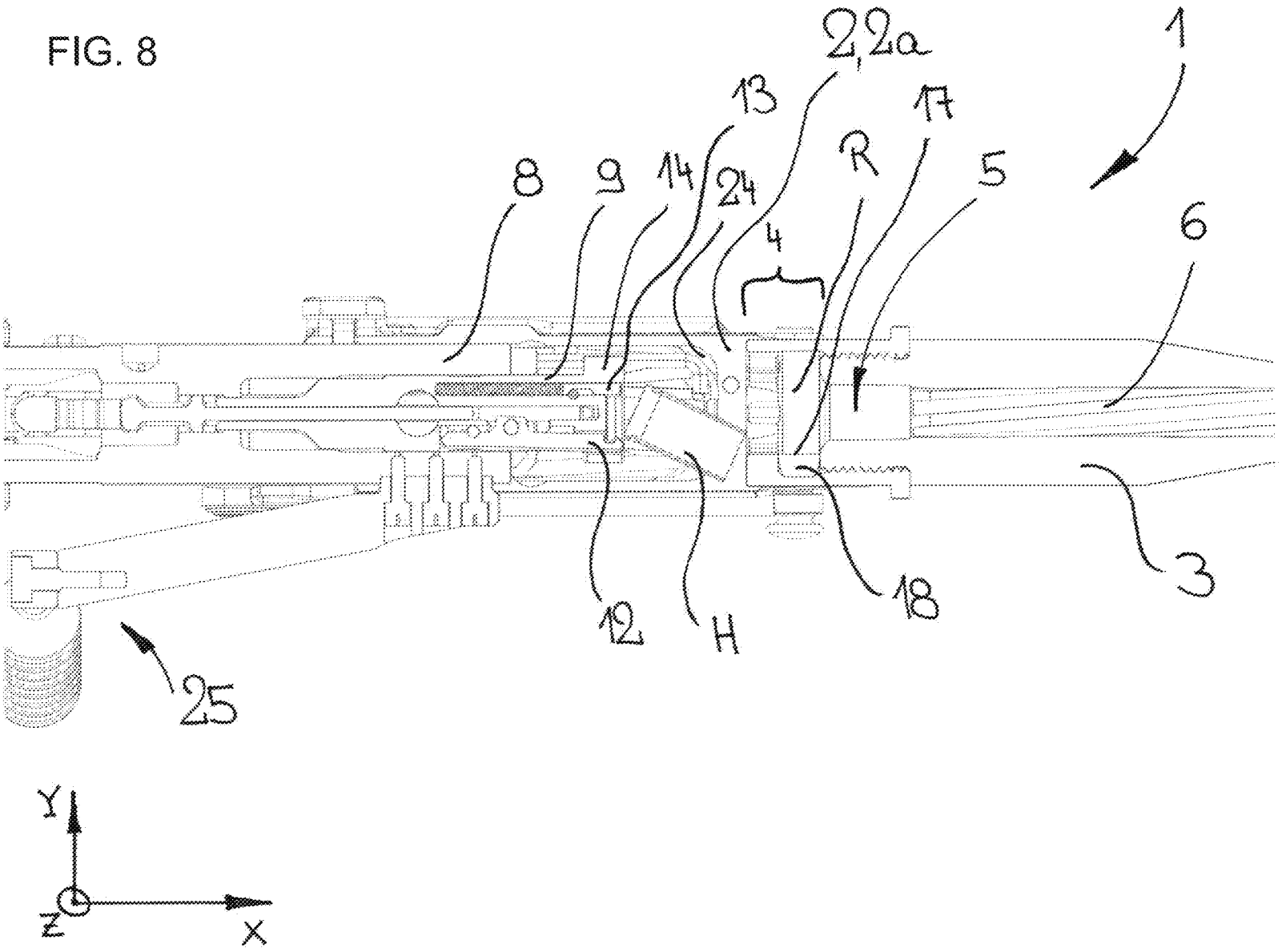
FIG. 8 shows a top view of an otherwise identical cross-sectional representation of the small firearm with the action open in a second stage.

The guide surface 17 provided within the locking space R is configured and arranged in such a way that the entry of a cartridge case H which during the movement of the action 8 from the closed position II to the open position I due to the interaction of the ejector 13 and extractor 12 is under the influence of a torque M, shown in FIG. 7, is limited to a maximum of 0.8 times the diameter $D_1$, which is shown here once again in addition to the illustration in the figure, optionally to a maximum of 0.65 times, optionally to a maximum of 0.5 times, optionally to a maximum of 0.33 times, optionally to 0.25 times and optionally to a maximum of 0.15 times the diameter $D_1$ of the cartridge case seating area in its root area. Indeed, it can be seen that although the guide surface 17 is set back from an imaginary projection of the inner surface of the jacket of the chamber 5 forming the diameter $D_1$ and thereby, in principle, permits penetration of the cartridge case H into the locking space R, it is however limited to a penetration depth corresponding to a distance of approximately 3% to 10% of (the amount of) the diameter $D_1$.

Figure 6B:
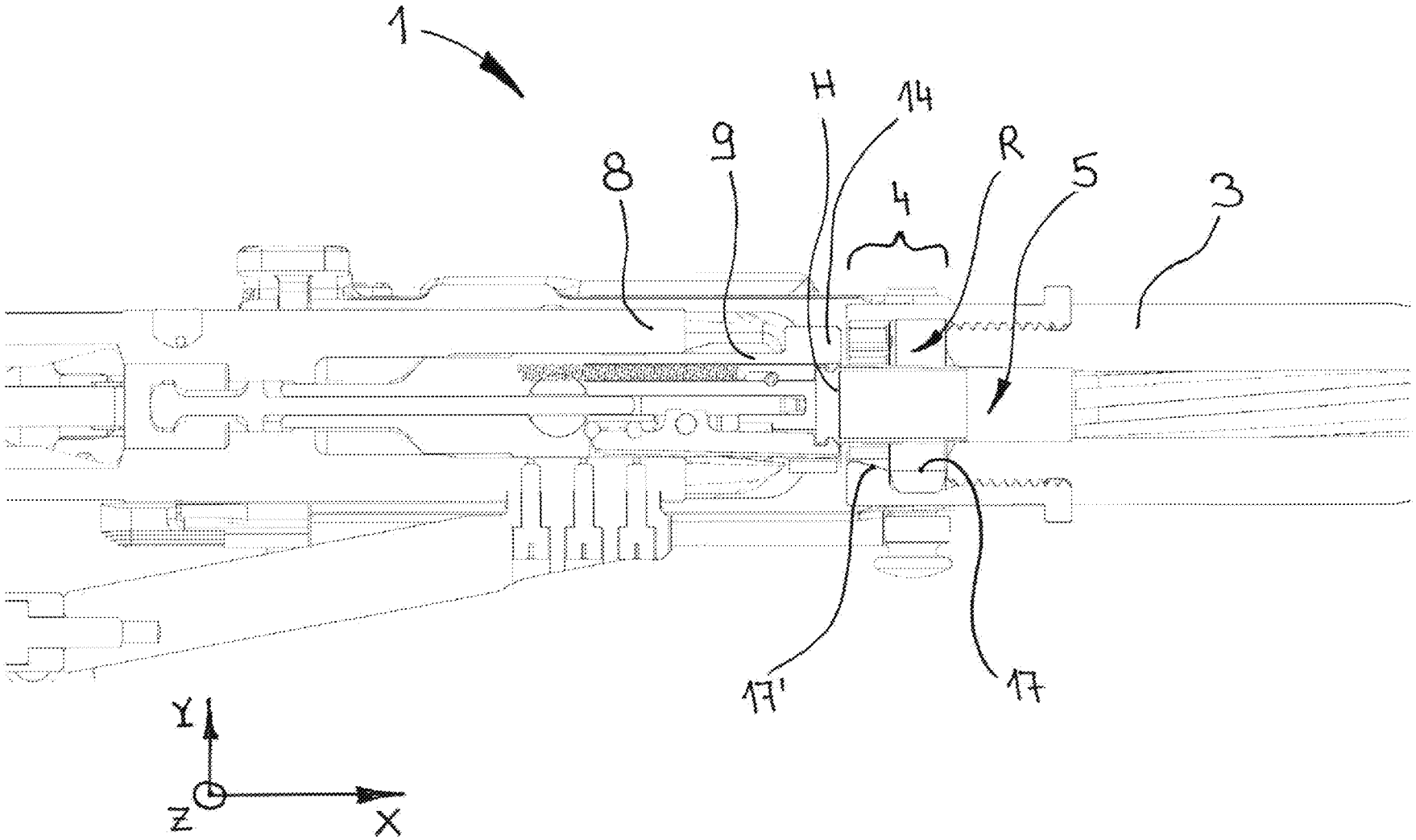
FIG. 6B shows a top view of a cross-sectional representation of the small firearm with partially opened action and cartridge case still partially in the chamber of the barrel (immediately after firing) in a further embodiment.

FIG. 6B shows a top view of a cross-sectional view of the small firearm 1 with partially opened action 8 and cartridge case H (immediately after the shot) still partially located in the chamber 5 of the barrel 3 in a further embodiment.

In a deviation from the embodiment shown in FIG. 6A, this embodiment here includes a first guide surface 17 and a second guide surface 17', which are provided within the locking space R, wherein the first guide surface 17 limits the entry of the cartridge case H, which is under the influence of a torque M during the movement of the action 8 from the closed position II to the open position I due to the interaction of the ejector 13 and extractor 12, and wherein the second guide surface 17' favors the exit of the cartridge case H from the locking space R.

The second guide surface 17' assumes an angle β of approximately 20° relative to the barrel bore axis A, so that the angle β is in the range between 12.5° and 65°, wherein in other embodiments it is possible that an optional range between 30° and 55° or even in an optional range between 32° and 45° can be formed in the positive and/or negative direction.

Apart from this, the illustration in FIG. 6B corresponds exactly to the illustration in FIG. 6A, with the additional exception that the block 18 forming the guide surface 17 is exchangeably mounted in the barrel 3 of the small firearm.

Figure 6C:
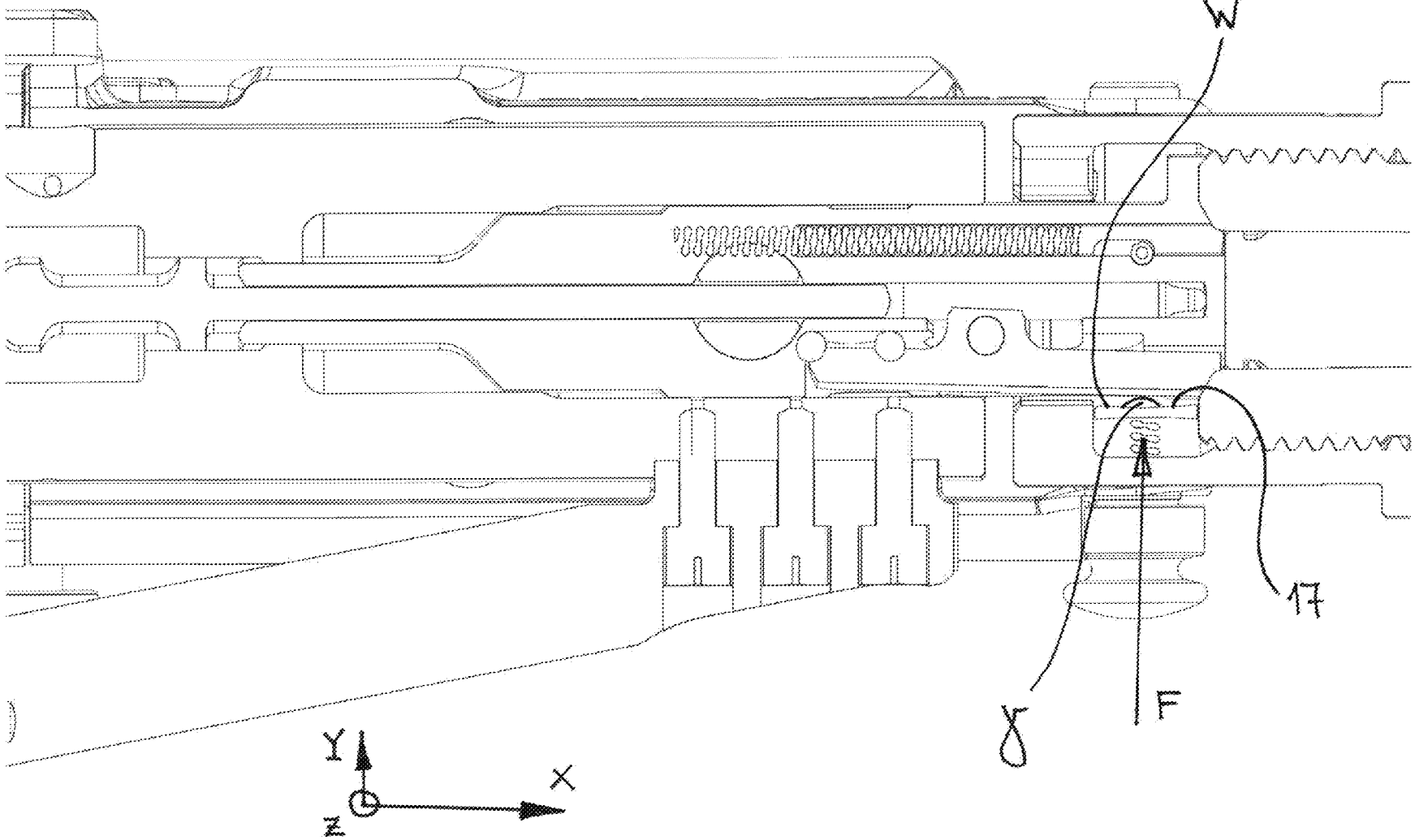
FIG. 6C shows a top view of a cross-sectional representation of the small firearm with partially opened action and cartridge case still partially in the chamber of the barrel (immediately after firing) in a further embodiment.

FIG. 6C shows a top view of a cross-sectional view of the small firearm 1 with the action 8 partially open and the cartridge case H partially still in the chamber 5 of the barrel 3 (immediately after the shot), in a further embodiment.

Deviating from the embodiment shown in FIG. 6A, the guide surface 17 is here arranged and/or configured to be movable, in particular movable within the locking space R.

Wherein the guide surface 17 in this embodiment can also be moved against a spring force F from a shown rest position V to a deflected position VI that is not shown, in which the cartridge (case) is able to penetrate deeper into the locking space R.

In addition, the guide surface 17 here includes a curvature W and an angle γ.

Figure 6D:
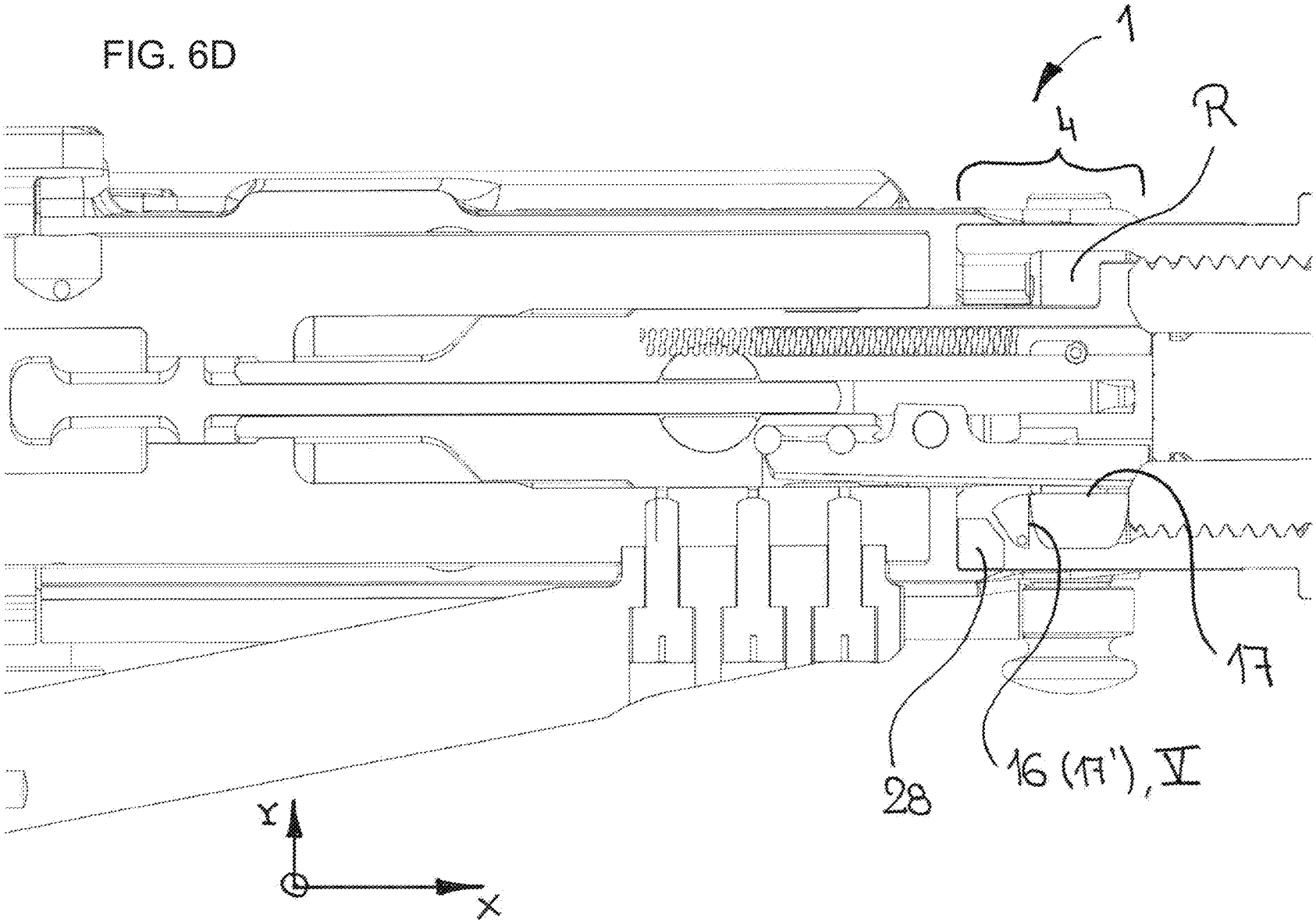
FIG. 6D shows a top view of a cross-sectional representation of the small firearm with partially opened action and cartridge case still partially in the chamber of the barrel (immediately after firing) in a further embodiment.
Figure 6E:
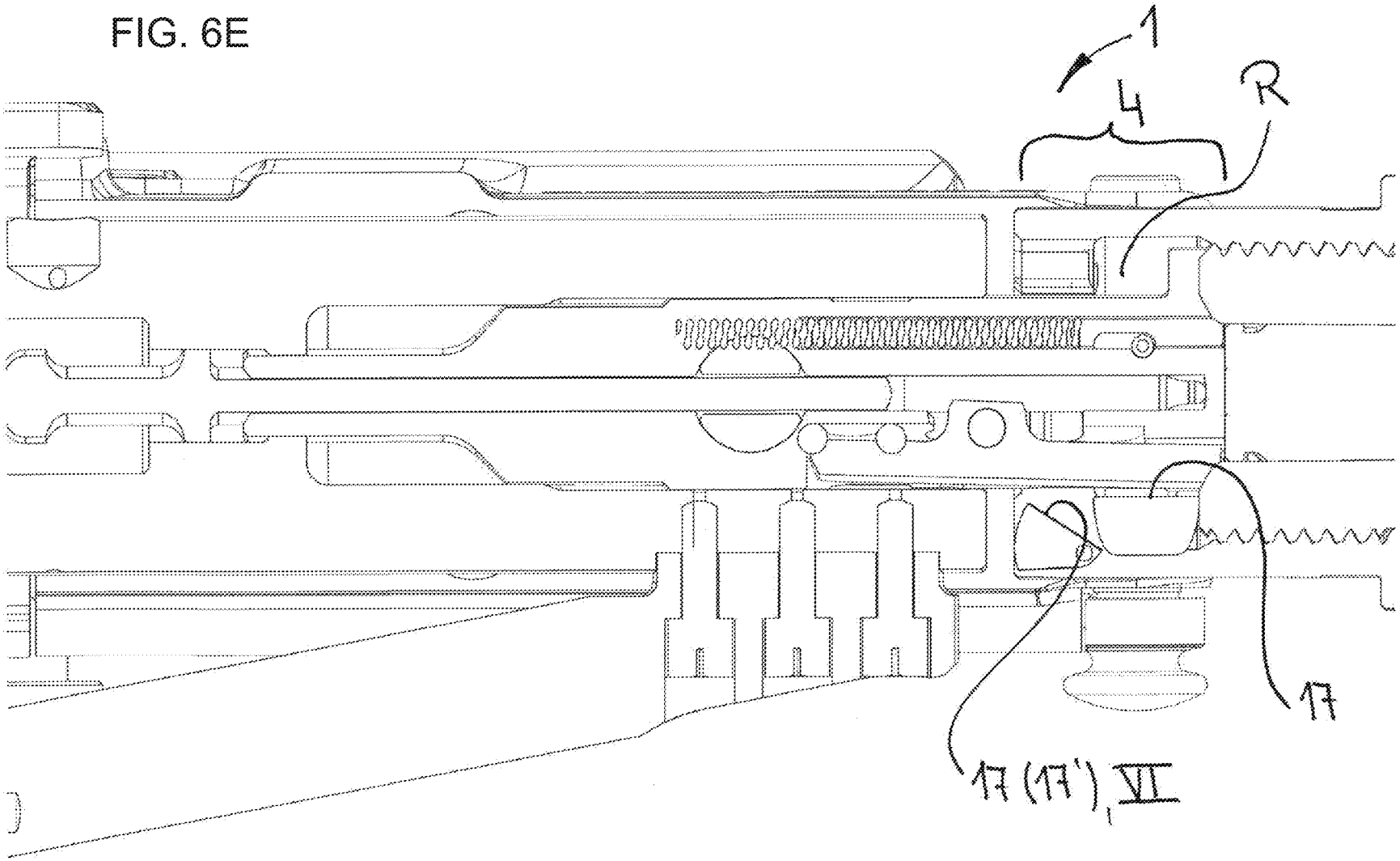
FIG. 6E shows a top view of a cross-sectional representation of the small firearm with partially opened action and cartridge case still partially in the chamber of the barrel (immediately after firing) in a further embodiment.

FIG. 6D and FIG. 6E show a further embodiment example in two different stages, with FIG. 6D showing the guide surface 17 in a first working position V, in which the guide surface 17 assumes the tasks of a bearing surface 16, and FIG. 6E showing the same embodiment example in a second working position VI, in which the guide surface 17 functions as such.

For this purpose, the guide surface 17, or the block 18 forming the guide surface 17, is pivotably arranged about an axis. So that the guide surface 17 can perform its function as a bearing surface 16 in the first working position V, the block 18 is fixed in its position in the first working position by a movably arranged bar 28.

It is of course possible to deviate from the embodiments shown in many ways without departing from the scope of the invention which is otherwise defined by the claims and the description.

LIST OF REFERENCE SIGNS

A Barrel bore axis
$D_1$ Diameter, diameter of the cartridge case seating area in its root area
F (Spring) Force, reaction force
H Case, cartridge case
$L_3$ Length, total length of the cartridge case seating area of the chamber
M Torque
P Cartridge
R Locking space/movement space
X Longitudinal direction (X-direction)
Y Width direction (Y-direction)
Z Height direction (Z-direction)
α Angle, first angle
β Angle, second angle
γ Angle, third angle
I Open position
II Closed position
III Unlocked position
IV Locked position
V Rest position
VI Deflected position
VII First working position
VIII Second working position
1 Small firearms
2 Receiver
2*a* Upper receiver (upper receiver part), "Upper"
2*b* Lower receiver (lower receiver part), "Lower"
3 Barrel
4 Locking mechanism area
5 Chamber
6 Guide area
7 Muzzle
8 Action
9 Bolt head
10 Axis of rotation (for bolt head)
11 Breech face
12 Extractor
13 Ejector
14 Locking piece
14*a* Locking piece
14*b* Locking piece
14*c* Locking piece
14*d* Locking piece
14*e* Locking piece
14*f* Locking piece
15 Bearing surface
15*a* Locking surface
15*b* Locking surface
15*c* Locking surface

15*d* Locking surface
15*e* Locking surface
15*f* Locking surface
16 Bearing surface
16*a* Bearing surface
16*b* Bearing surface
16*c* Bearing surface
16*d* Bearing surface
16*e* Bearing surface
16*f* Bearing surface
17, 17' Guide surface
18 Block
19 Edge area (of the locking or movement space)
19*a* Part of the edge area (of the locking or movement space)
20 Turning point
21 Butt stock
22 Fore-end
23 Magazine well
24 Magazine
25 Operating element (bolt handle, loading lever)
26 Safety (selector element)
27 Trigger
28 Bar While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A small firearm, extending along a longitudinal direction, a width direction, and a height direction, the small firearm comprising:

a receiver;

a barrel including a barrel bore axis;

an action including a bolt head; and a guide surface, wherein the receiver is configured for (i) at least indirectly receiving the barrel including a locking mechanism area, a chamber, a guide area, and a muzzle arranged successively in the longitudinal direction, and (ii) at least indirectly receiving the action movably arranged within the receiver along the longitudinal direction from an open position to a closed position, wherein the bolt head includes a breech face, an extractor, an ejector, and at least one locking piece with at least one locking surface, wherein the locking mechanism area includes at least one bearing surface with which the at least one locking surface is configured for being brought into contact in the closed position, wherein the locking mechanism area further includes a locking space, within which the at least one locking piece is configured for being moved from an unlocked position to a locked position in a region of the small firearm corresponding to the closed position, wherein the guide surface, which is within the locking space, is configured such that at least one of (i) an entry of a cartridge case under an influence of a torque during a movement of the action from the closed position to the open position is limited due to an interaction of the ejector and the extractor and (ii) an exit of the cartridge case is favored.

2. The small firearm according to claim 1, wherein the chamber has a length and a diameter, the quotient of which is a dimensionless quantity between 0.66 and 3.66.

3. The small firearm according to claim 1, wherein the small firearm is configured as a repeating weapon.

4. The small firearm according to claim 1, wherein the small firearm is configured as at least a partially automatic small firearm.

5. The small firearm according to claim 1, wherein the guide surface is rigid.

6. The small firearm according to claim 1, wherein the guide surface is at least one of arranged and configured to be movable within the locking space.

7. The small firearm according to claim 1, wherein the guide surface is configured for being moved against a spring force from a rest position to a deflected position.

8. The small firearm according to claim 1, wherein the guide surface forms at least part of an edge area of the locking space.

9. The small firearm according to claim 1, wherein the guide surface forms at least one angle ($\alpha$) relative to the barrel bore axis in a range of between −15° and +15°.

10. The small firearm according to claim 1, wherein the guide surface forms at least one angle ($\beta$) relative to the barrel bore axis in a range of between 12.5° and 65° in at least one of a positive direction and a negative direction.

11. The small firearm according to claim 1, wherein the guide surface includes at least one angle ($\gamma$).

12. The small firearm according to claim 1, wherein the guide surface includes at least one curvature.

13. The small firearm according to claim 1, wherein the guide surface provided within the locking space is configured and arranged in such a way that the entry of the cartridge case under the influence of the torque during the movement of the action from the closed position to the open position is limited due to the interaction of the ejector and the extractor to a maximum of 0.8 times the diameter of the cartridge case seating area of the chamber in a root area of the cartridge case seating area.

14. The small firearm according to claim 1, wherein the guide surface provided within the locking space is configured and arranged in such a way that the exit of the cartridge case, which has entered the locking space during the movement of the action from the closed position to the open position due to the interaction of the ejector and the extractor under the influence of the cartridge case under torque, is favored to at least 0.5 times of an amount of the entry.

15. The small firearm according to claim 1, wherein the action is arranged within the receiver such that the action is configured for being moved along the longitudinal direction, and the bolt head is arranged in the action such that the bolt head is configured for being rotated about an axis of rotation extending in the longitudinal direction.

16. The small firearm according to claim 1, wherein the action is arranged within the receiver such that the action is configured for being moved along the longitudinal direction, and the bolt head is firmly connected to the action.

17. The small firearm according to claim 1, wherein the action, at least in part, is configured as an expanding head lock.

18. The small firearm according to claim 1, wherein the small firearm is configured as a long gun.

19. The small firearm according to claim 1, wherein the small firearm is configured as a handgun.

20. A method for operating a small firearm, the method comprising the steps of:

providing that the small firearm extends along a longitudinal direction, a width direction, and a height direction and includes:

a receiver;

a barrel including a barrel bore axis;

an action including a bolt head; and a guide surface, wherein the receiver is configured for (i) at least indirectly receiving the barrel including a locking mechanism area, a chamber, a guide area, and a muzzle arranged successively in the longitudinal direction, and (ii) at least indirectly receiving the action movably arranged within the receiver along the longitudinal direction from an open position to a closed position, wherein the bolt head includes a breech face, an extractor, an ejector, and at least one locking piece with at least one locking surface, wherein the locking mechanism area includes at least one bearing surface with which the at least one locking surface is configured for being brought into contact in the closed position, wherein the locking mechanism area further includes a locking space, within which the at least one locking piece is configured for being moved from an unlocked position to a locked position in a region of the small firearm corresponding to the closed position, wherein the guide surface, which is within the locking space, is configured such that at least one of (i) an entry of a cartridge case under an influence of a torque during a movement of the action from the closed position to the open position is limited due to an interaction of the ejector and the extractor and (ii) an exit of the cartridge case is favored; and using the small firearm.

* * * * *